United States Patent [19]

Beck

[11] 3,931,887

[45] Jan. 13, 1976

[54] PACKAGING STRUCTURE FOR ITEMS PROVIDED ON WIRES OR CORDS

[75] Inventor: Frederick R. Beck, Valparaiso, Ind.

[73] Assignee: McGill Manufacturing Company, Inc., Valparaiso, Ind.

[22] Filed: July 22, 1974

[21] Appl. No.: 490,582

[52] U.S. Cl. ..... 206/419; 206/420; 229/14 R

[51] Int. Cl.[2] ..... B65D 5/50; B65D 85/42

[58] Field of Search ..... 206/45.14, 45.19, 49, 388, 206/389, 395, 419, 420, 491, 521; 229/14 R, 14 BE, 14 BW, 14 C

[56] References Cited

UNITED STATES PATENTS

| | | | |
|---|---|---|---|
| 2,943,732 | 7/1960 | Kovaleski et al. | 206/389 |
| 3,127,990 | 4/1964 | Krupp | 206/388 |
| 3,384,227 | 5/1968 | Spatz | 206/420 |

*Primary Examiner*—William Price
*Assistant Examiner*—Steven E. Lipman
*Attorney, Agent, or Firm*—Foorman L. Mueller

[57] ABSTRACT

Packaging structure for an assembly of items which are strung on a wire or cord, such as a stringer light assembly which includes a plurality of lamps connected at spaced points to conductors and a support and guard device for each lamp. The packaging structure includes a container having a base and folding portions connected thereto adapted to form sides and a top for the container. A liner is positioned on the base which has a wall of decagonal shape which serves as a form around which the conductors can be wrapped or wound. A slot is provided in each side of the wall for allowing the conductors to pass therethrough so that the lamps and the associated support and guard devices can be positioned on the base within the wall. A plurality of the walls have extensions or projections at the edges thereof which serve to retain the conductors therebetween. The stringer light assembly when so packaged can be easily dispensed by opening the top of the container, fastening the ends of the conductors to a fixed object and unwinding the conductors from the liner, with the conductors sliding out of the slots therein. The stringer light assembly can be positioned for use without encountering tangling of the conductors and devices.

3 Claims, 6 Drawing Figures

12
14a
20
24a
28
29
30
32
33
33a
33b
34
35
36
38
40
41
42
43
44
46
47
1
2
3
4
5
6
7
8
9
10

PACKAGING STRUCTURE FOR ITEMS PROVIDED ON WIRES OR CORDS

BACKGROUND OF THE INVENTION

It is common practice at construction sites to install stringer light assemblies for lighting an area, such as a floor of a building, while the construction is taking place. For safety reasons guards must be provided about the lamps to protect the same, since the stringer light assemblies may be used in places where substantial construction activity is taking place. In many cases, the electrical conductors are first strung and then lamps are connected thereto, but this requires substantial on the job time on the part of electricians. Light sets have been assembled in one area and then moved to another area for installation, but movement of the assemblies has caused tangling of the conductors.

Although it has been proposed to preassemble the stringer light assemblies so that they can be constructed at less cost than when constructed by electricians on the job, the problem has been encountered when installing the assemblies that the conductors tend to become tangled with each other and with the lamps, with the result that substantial time is required to straighten out the conductors prior to the installation of the stringer light assemblies. As a result, little economy has been accomplished by preassembly of the stringer light assemblies.

SUMMARY OF THE INVENTION

An object of the invention is to provide an improved structure for assembling, storing, and transporting an assembly of items positioned along a wire or a cord, which also facilitates dispensing the assembly.

A further object of the invention is to provide a packaging structure for an item such as a stringer light assembly, which is suitable for holding the assembly during shipment, and which can be easily opened for dispensing the assembly without removing the entire assembly from the container.

Another object of the invention is to provide a packaging structure for a stringer light assembly which includes a container for holding and protecting the assembly, with a liner in the container which serves as a form for wrapping the conductors and which also provides spaces for receiving the lamps and supported guard devices for the lamps.

In accordance with the invention the packaging structure includes a container, which may be made of cardboard, which has a base portion with integral folded portions connected thereto which are shaped to form sides for the container. The container can have integral parts forming a top, or a separate top. A liner is positioned on the base of the container which has a wall of generally cylindrical shape, which serves as a form around which wires or cords on which items, such as lamps, are strung can be wrapped. The wall can be of decagonal shape and have a slot in each side through which the wires can pass for positioning the items within the liner. The container is illustrated for use with a stringer light assembly having lamps and associated support and guard devices which extend from near the center of the liner to the junction between two adjacent sides of the liner wall. The apex between the two sides serve to retain the device in a substantially fixed position. The liner may also be formed of cardboard and may be constructed of two identical pieces which are secured together, as by stapling. Any other number of pieces can be used, such as ten pieces which are attached together. A plurality of the sides of the liner can have extensions which project from the outer surface thereof for retaining the conductors therebetween. The container can be closed for shipment and storage of the stringer light assembly, and then the top can be opened for dispensing the assembly with the liner remaining on the base of the container. During installation one end of the wires or conductors can be fastened to a fixed object and the packaging structure can then be moved away from the object with the conductors unwinding from the liner and slipping out of the slots to allow the lamps and associated devices to be removed from within the wall of the liner. Alternatively, the conductors and lamps can be pulled out of the container while the container is stationary. The packaging structure can be used for other assemblies of items strung on wires or cords in the same manner as for the stringer light assembly which has been illustrated.

DETAILED DESCRIPTION

Figure 1:
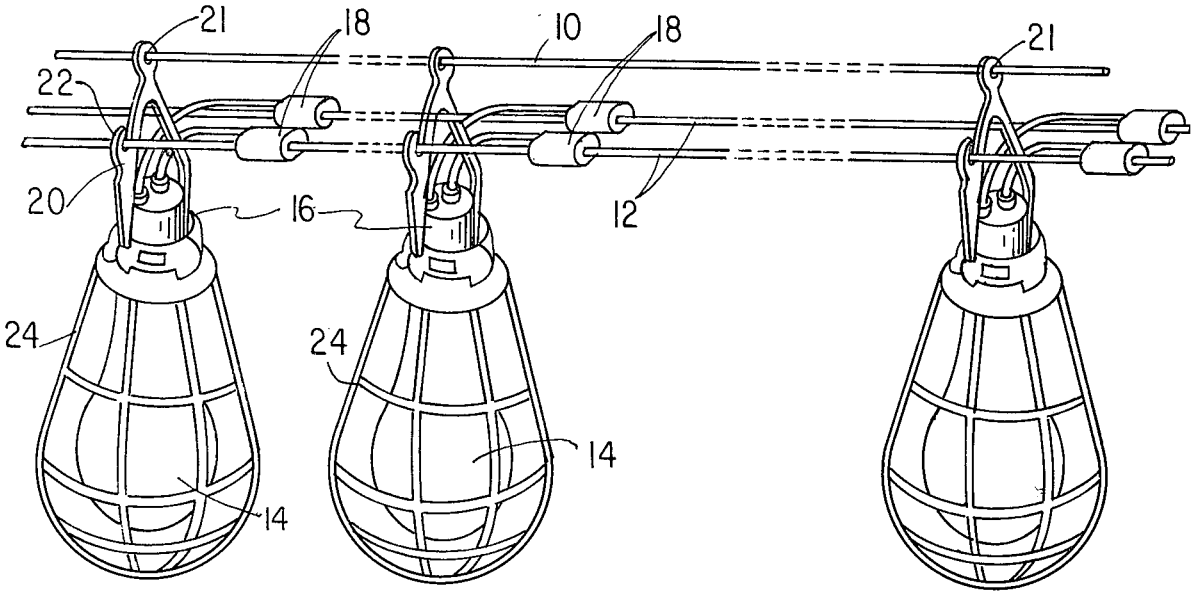
FIG. 1 illustrates a stringer light assembly which may be packaged by the structure of the invention.

Referring to FIG. 1, there is illustrated a stringer light assembly adapted to be supported on a messenger wire 10. The assembly includes electrical conductors 12 which may be connected to the conventional 110 volt electrical power supply. A plurality of lamps 14 are energized from the conductors, being secured in sockets 16 having conductors connected to the conductors 12 by connectors 18. Secured to each socket 16 is a support 20 and a guard 24. The support 20 may be made of insulating material, such as plastic, and have a supporting portion 21 with openings to receive the messenger wire 10 for supporting the same. Hooks 22 are provided on the support 20 for holding the conductors 12 from the messenger wire 10. The support 20 and guard 24 may be connected to the socket 16 in any known manner.

The lamps 14 will be positioned at spaced intervals, which may be 10 feet intervals, so that the conductors 12 are relatively long. In a stringer light assembly having ten lights, the conductors will be 90 feet long between the first and last light, and it may be desired to have a ten foot leader for connecting the first light to a power supply. Accordingly, the conductors will be about 100 feet long. If the conductors and lamps with the support and guard devices therewith are randomly placed in a container, there is great likelihood that the conductors will become tangled, and/or the conductors will become wound around the guard devices in such a way that it is difficult to string up the light assembly.

Figure 2:
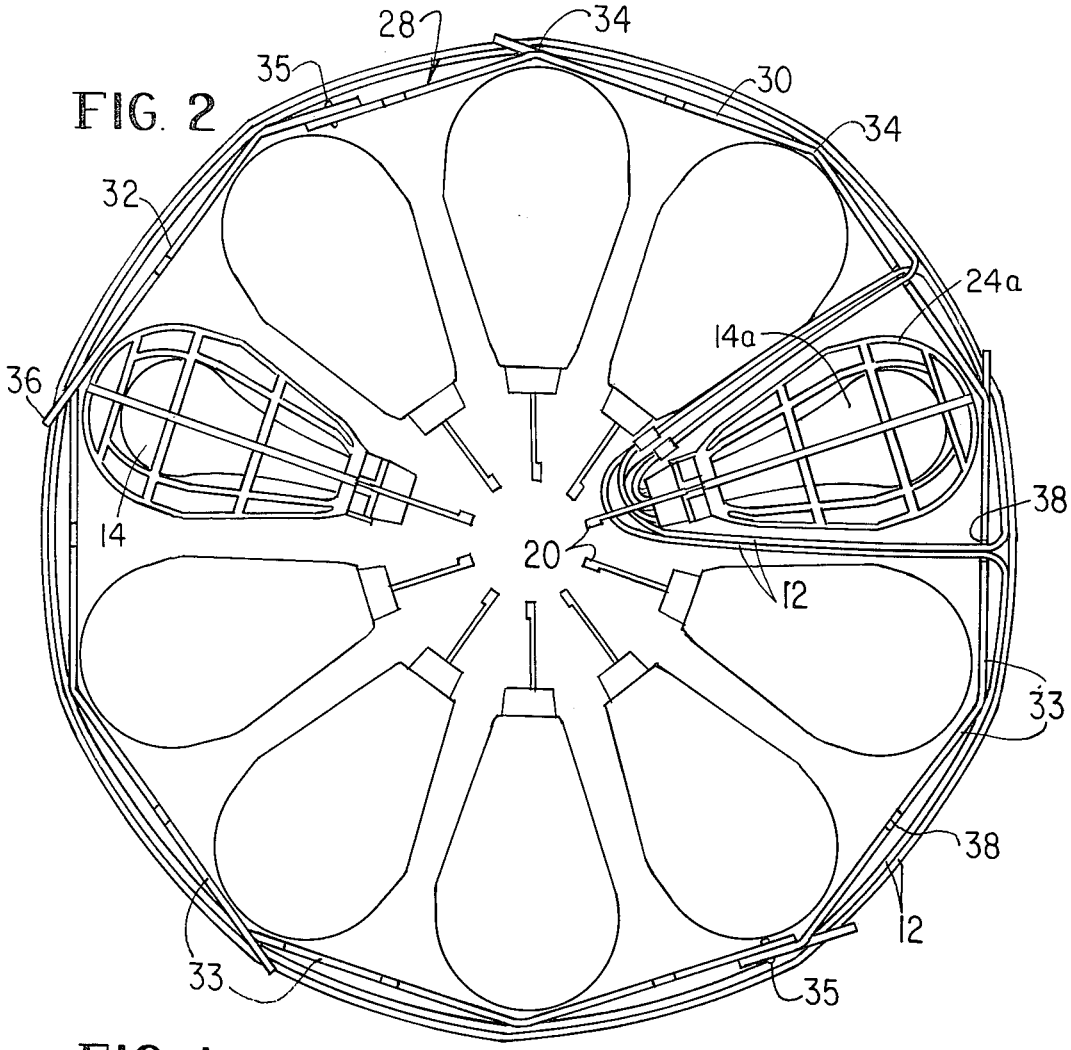
FIG. 2 is a top view of the stringer light assembly positioned with respect to the liner.
Figures 3, 4, 5, 6:
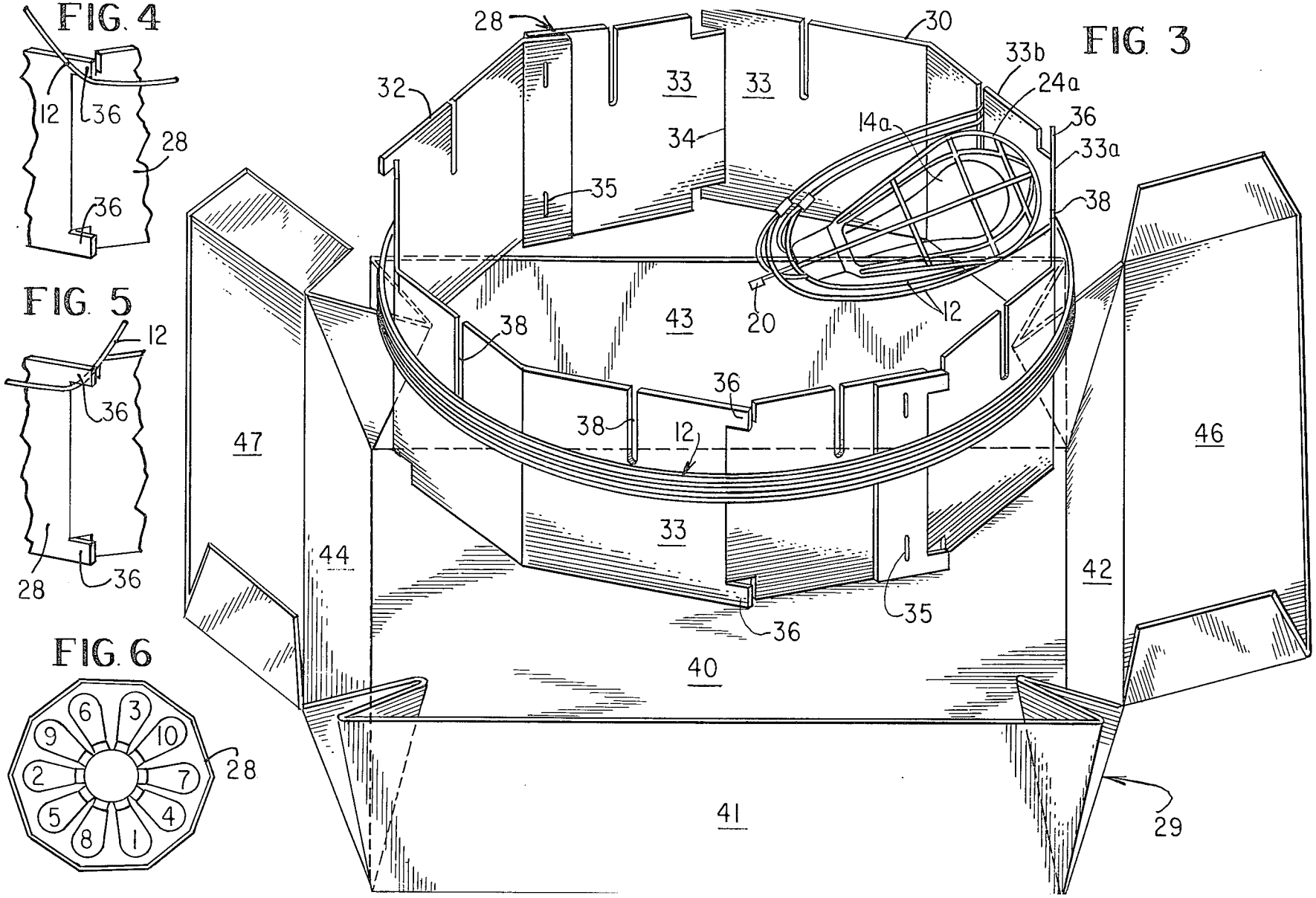
FIG. 3 is an exploded view showing the packaging of the stringer light assembly with respect to the liner and the container.
FIGS. 4 and 5 illustrate the unwinding of the stringer light assembly from the liner.
FIG. 6 illustrates one positioning arrangement of the lamps within the liner.

FIG. 2 is a top view of the liner 28 of the packaging structure, and FIG. 3 is an exploded view showing the liner 28 with the stringer light assembly positioned thereon, adjacent the container 29 in which the assembly can be stored and shipped. The liner 28 is formed by two parts 30 and 32, which are of identical construction. The parts may be formed of cardboard which are creased to form the angles 34 between adjacent sides 33. The two parts are connected together as by staples 35 and when so connected form a decagonal shaped wall. This wall is of generally cylindrical configuration and will be so referred to in the specification. A plurality of the sides 33 have projections 36 extending therefrom for retaining the conductors, as will be described. Each side 33 of the liner has a slot 38 therein through which the conductors can extend.

Referring to FIG. 3, it will be seen that the conductors 12 are wound around the liner 28 between the projections 36 which extend from certain of the sides 33 at the top and bottom thereof. The conductors 12 extend through the slots 38 toward the center area of the liner so that the support 20 for the lamp is positioned at this center area. The lamps 14 extend from the center to the liner, with the guards 24 being positioned at the junction between two sides 33 of the liner 28. The lamp 14*a* illustrated in FIG. 3 has its guard 24*a* positioned at the junction between the sides marked 33*a* and 33*b*. The conductors 12 hold the lamp so that the guard 24*a* rests against the liner, to retain the lamp 14*a* in a substantially fixed position. The other nine lamps 14 are similarly held within the liner 28 with the guards 24 thereof engaging two adjacent sides 33.

FIG. 3 illustrates a container 29 for the stringer light assembly which includes a base 40 having portions connected thereto which forms sides 41, 42, 43 and 44 for the container. Top portions 46 and 47 are connected to the sides 42 and 44, respectively, so that the container 29 can completely enclose the liner 28 with the stringer light assembly positioned thereon. This forms a suitable package for storing or shipping a stringer light assembly. It is to be pointed out that other container configurations can be used with the liner and assembly thereon, which fall within the invention.

When the stringer light assembly is to be installed, it can be transported to the desired location within the container 29, and the top portions 46 and 47 can be folded back, as shown in FIG. 3. The lead ends of the conductors 12 can be secured to a fixed object, and the container can be moved so that the conductors 12 unwind from the liner 28. As the conductors 12 are unwound to a point where a lamp 14 is connected, the conductors will slide out of the slot 38 so that the lamp 14 can be removed from within the liner 28, and the conductors 12 will continue to unwind to the next lamp. It will be apparent that the assembly can be removed from the container and liner by pulling out the conductors while the container is held stationary. It is therefore seen that the stringer light assembly can be dispensed from the liner without the likelihood that the conductors will become entangled, either with each other or with the support and guard structures of the lamps.

The direction that the conductors 12 are wound on the liner, and the direction that the projections 36 extend from the sides 33, are related so that when the conductors are removed, they do not catch on the projections. This is illustrated in FIG. 4 wherein the projection 36 tends to bend over or collapse so that the conductor 12 can be pulled from the liner 28. If the conductor 12 is wound in the opposite direction, it will catch on the projection 36, as shown in FIG. 5, and the pull will bring the conductor in tight engagement with the projection. The projections 36 are effective, however, to prevent the conductors 12 from sliding off the liner 28 during handling.

The dimensions of the liner, the number of sides and the order in which the lamps are positioned in the spacers can be changed as required for different applications, and to provide the desired length of the conductors between lamps on the string. The conductors can make any desired number of turns around the liner, and the particular slot 38 through which the conductors extend to position the next lamp can be selected as desired. For example, the conductors can be arranged to provide two turns around the liner after each lamp is positioned, less one space, so that the next lamp will be positioned just ahead of the previous lamp. If it is desired to provide closer spacing of the lamps, the conductors can be positioned in the slot 38 so that after one lamp is positioned, the conductors make one full turn around the liner and then skip two positions so that the next lamp is positioned in the third space after the first lamp. Such an arrangement is shown in FIG. 6. Obviously other numbers of turns about the liner, and other positioning of the lamps can be used so that the same liner is suitable for use with different spacings of the lamps, as may be required in different applications.

Although the container 29 has been illustrated as formed of a single piece of material, such as cardboard, which is folded to provide sides and a top, it will be apparent that the container can be of any other suitable construction. For example, the top can be a separate part as commonly used in boxes.

While the packaging structure of the invention has been described for use for holding a string of lamps, it is obvious that this structure is suitable for use to hold other objects which are secured to a conductor or cord. For example, parking lot markers which are spaced along a cord can be packaged for storage and transportation in a container as illustrated, with the same advantages when storing, shipping and setting up the markers.

I claim:

1. In a package including a walled container which can be opened at the top and has a closed bottom for packaging therein a string-of-lights product having elongated wire conductor means therewith and a plurality of electric lamp sockets electrically connected thereto, the combination including a removable liner positionable within said container comprising a wall of generally cylindrical shape with a top edge and standing upright in said container and spaced away from but within the wall of said container, a string-of-lights product comprising wire conductor means and a plurality of assemblies, each assembly electrically connected to said wire conductor means at predetermined positions over the length thereof, with each assembly including a lamp socket, electrical connector means, and means associated with the socket, said liner having therewith means for maintaining said elongated wire conductor means on the outside of said liner intermediate the top edge and the bottom of the wall of said liner, and said liner having a plurality of slots therein, with each slot extending from the top edge of said liner downwardly a predetermined distance into the wall of said liner and corresponding at least in number to said assemblies for said product, with said wire conductor means insertable into and positioned in a slot while said product is packaged in said container, and with each said assembly being positioned inside said liner and resting on the bottom of the container, said product being removable from said container by unwrapping the wire conductor means from around the liner and removing said assemblies from the container by withdrawing each assembly upwardly out of the container to in turn withdraw the wire conductor means upwardly and out of a corresponding slot, with said upward movement of said wire conductor means and the assemblies being accomplished without impeding the wire conductor means on the outside of said liner as the total product is being removed from said container.

2. In a package as defined in claim 1 wherein said means for positioning said conductor means on the outside of said liner comprises yieldable projections in pairs spaced apart vertically from one another and with one adjacent the top edge and one adjacent the bottom of the liner wall, and said liner having a plurality of such pairs of projections positioned around the outside of said liner wall and each pair circumferentially spaced from each other.

3. In a pacakge as defined in claim 1 wherein the means associated with the socket in each assembly includes a lamp guard, and wherein each assembly and said conductor means in being withdrawn upwardly from said liner is done so in a direction axially of said liner.

* * * * *